US007351132B2

(12) United States Patent
Travini

(10) Patent No.: US 7,351,132 B2
(45) Date of Patent: Apr. 1, 2008

(54) FLAP WHEEL, IN PARTICULAR FLAP WHEEL FOR SATIN FINISHING SYSTEMS FOR PIPES OR FOR SHEET METAL AND METHOD OF PRODUCING THE SAME

(75) Inventor: Vittorio Travini, Borgo San Siro (IT)

(73) Assignee: Olimpia 80 S.R.L., Borgo San Siro (PV) (IT)

( * ) Notice: Subject to any disclaimer, the term of this patent is extended or adjusted under 35 U.S.C. 154(b) by 0 days.

(21) Appl. No.: 11/384,414

(22) Filed: Mar. 21, 2006

(65) Prior Publication Data

US 2006/0217047 A1 Sep. 28, 2006

(30) Foreign Application Priority Data

Mar. 23, 2005 (IT) ..... MI2005A0483

(51) Int. Cl.
*B24B 57/00* (2006.01)

(52) U.S. Cl. ..... 451/466; 451/469; 451/490

(58) Field of Classification Search ..... 451/466, 451/468, 469, 490; 15/230, 230.17
See application file for complete search history.

(56) References Cited

U.S. PATENT DOCUMENTS 2,978,845 A 4/1961 Haven
3,165,867 A 1/1965 Murray
3,200,543 A * 8/1965 O'Neil, Jr. et al. ..... 451/469
3,462,888 A 8/1969 Yokel
3,600,861 A * 8/1971 Haywood ..... 451/468
3,706,167 A 12/1972 Schaffner
3,795,498 A * 3/1974 Hasegawa ..... 51/297
4,090,333 A * 5/1978 Block et al. ..... 451/468
4,275,529 A * 6/1981 Teetzel et al. ..... 451/466
4,455,788 A * 6/1984 Freerks ..... 451/466

FOREIGN PATENT DOCUMENTS

DE 296 16 466 U1 2/1997

* cited by examiner

*Primary Examiner*—Dung Van Nguyen
(74) *Attorney, Agent, or Firm*—Young & Thompson

(57) ABSTRACT

A flap wheel (1) for satin finishing systems for pipes or for sheet metal, includes a plurality of radial flaps (2) fixed to the hub (3) of the flap wheel (1) by coupling elements integral with the hub (3) of the flap wheel (1) and inserted in seats (8) formed in each flap (2) near the edge (14) thereof adjacent the hub (3). The hub (3) is advantageously hollow and has, in its inside wall, annular grooves (10) which are identical and parallel each other; the flaps (2) are further connected to the hub (3) by gluing, pouring inside the hub (3) an adhesive which flows out through a plurality of rows of through holes (9) formed in the wall of the hub (3) to coinciding with the annular grooves (10). A method of producing the flap wheel is also described.

11 Claims, 5 Drawing Sheets

FLAP WHEEL, IN PARTICULAR FLAP WHEEL FOR SATIN FINISHING SYSTEMS FOR PIPES OR FOR SHEET METAL AND METHOD OF PRODUCING THE SAME

FIELD OF THE INVENTION

The present invention refers to a flap wheel, in particular to a flap wheel for satin finishing systems for pipes or for sheet metal and to a method of producing said flap wheel.

BACKGROUND OF THE INVENTION

Systems for satin finishing pipes by means of flap wheels—that is by means of wheels comprising a plurality of radial flaps (normally) fixed by gluing to a hub—have long been known and are used with good results since, with respect to the systems of the prior art, they allow a better surface finish of the pipe and a higher production rate.

The flap wheels currently available on the market have not allowed the above-mentioned flap-wheel satin finishing systems to fully realize their potential since it has been found experimentally that during the satin finishing of a pipe (also because of the heat that develops by friction between the flaps and the surface to be satin finished) the temperature of the wheel (and in particular of its hub) reaches such high values (a temperature of 120-150° C. has been measured at the hub) as to (be able to) cause a physical alteration in the components used to produce the flap wheel, degrading in particular the mechanical binding and cohesive characteristics of the material (normally a resin) used as adhesive to fix the flaps to the hub.

This fact, together with the high speed of the wheel (which can have a peripheral speed of 30-35 m/s), means that the material used as adhesive loses (or can lose) its ability to retain the flaps in place, overcoming the centrifugal force acting on said flaps: it has in fact been found experimentally that the flaps gradually become detached from the wheel hub and consequently the life of the wheel, its ability to effectively remove the material from the surface to be processed and the safety of the operators are reduced, unless the wheel is placed beneath a sufficiently robust cover.

The object of the present invention is to produce a flap wheel, in particular a flap wheel for satin finishing systems for pipes or for sheet metal, that is free from the drawbacks and from the limitations of the flap wheels currently known to the art.

BRIEF DESCRIPTION OF THE DRAWINGS

The invention will now be described with reference to a purely exemplifying (and therefore non-limiting) embodiment thereof, illustrated in the appended figures, in which.

In the appended figures corresponding elements will be denoted by the same reference numerals.

DETAILED DESCRIPTION OF THE INVENTION

Figure 1:
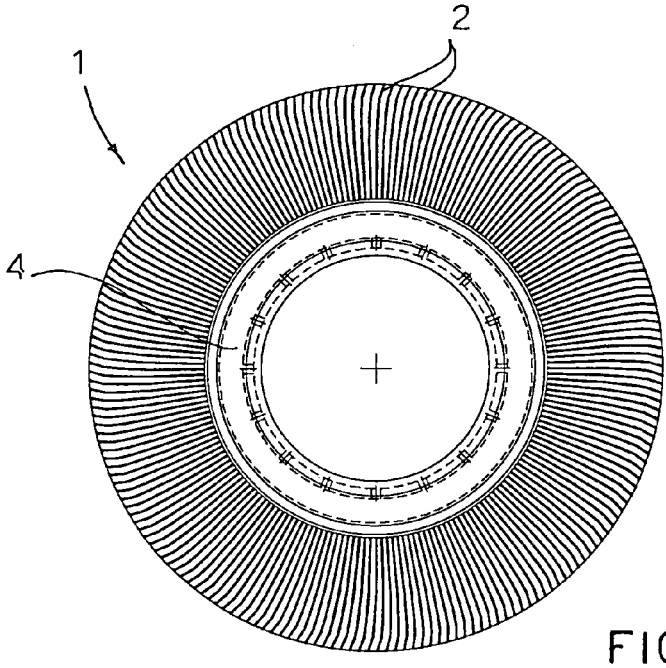
FIG. 1 shows diagrammatically a side view of a flap wheel.

FIG. 1 shows diagrammatically a side view of a flap wheel 1, which comprises a plurality of radial flaps 2 placed between two side flanges 4 (only one of which is visible in FIG. 1) and fixed to a hub 3, not visible in FIG. 1 because it is covered by the flange 4.

Figure 2:
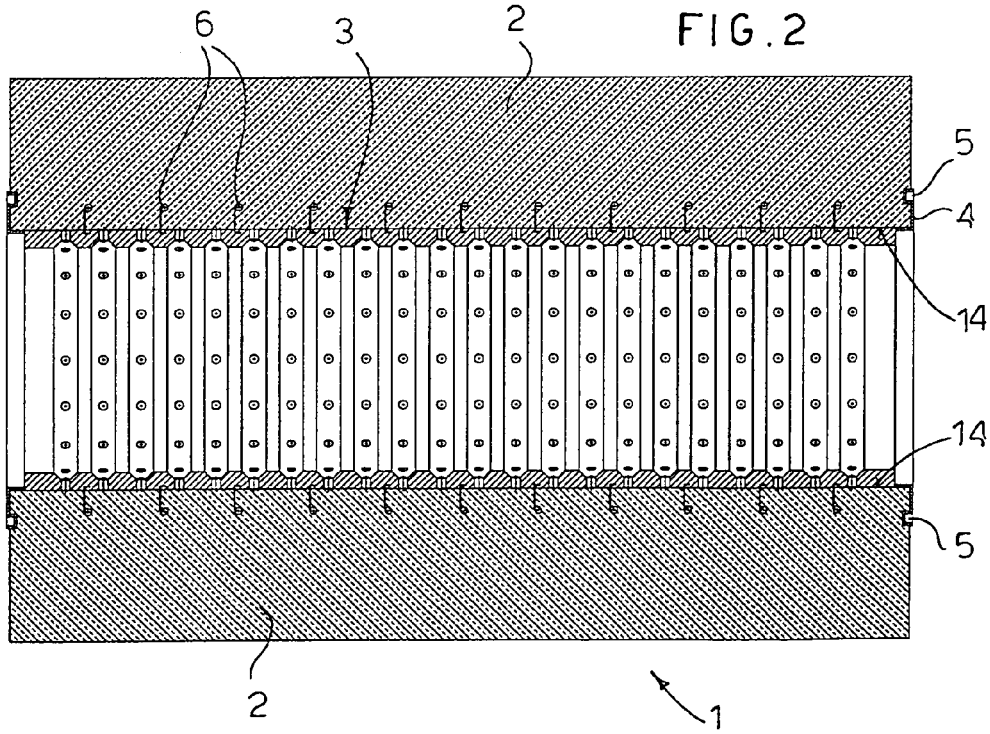
FIG. 2 shows diagrammatically a flap wheel produced according to the invention, sectioned along a plane passing through its longitudinal axis of symmetry.

FIG. 2 shows diagrammatically a flap wheel 1 produced according to the invention, sectioned along a plane passing through its longitudinal axis of symmetry.

The flap wheel 1 comprises a plurality of radial flaps 2 (two of which can be seen in the sectional view of FIG. 2) fixed to the hub 3 by means of coupling means 6, integral with the hub 3 and inserted in seats 8 (not visible in FIG. 2 because they are occupied by the coupling means 6) formed in each flap 2 near the edge 14 thereof adjacent the hub 3.

The hub 3 can be made, in a per se known manner, of metal, of plastic material and/or of other functionally equivalent material.

The coupling means 6 are advantageously equidistant from one another.

Figure 3:
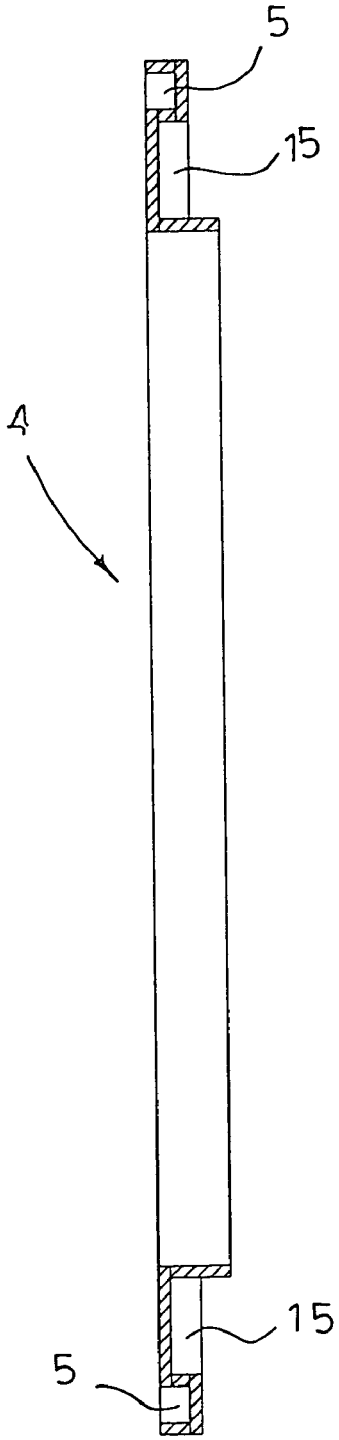
FIG. 3 shows diagrammatically, in section, a terminal flange of a flap wheel.

The radial flaps 2 are placed between the two side flanges 4, one of which is shown—in section—in FIG. 3.

Figure 6:
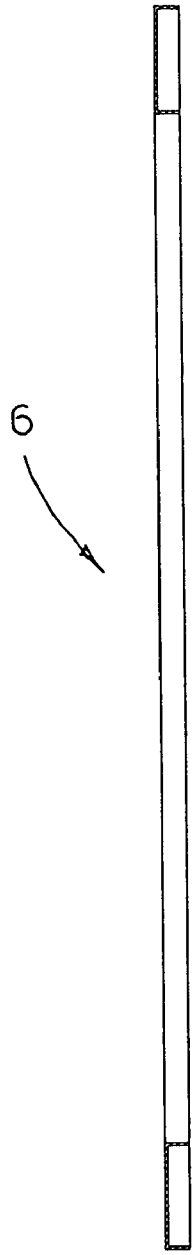
FIG. 6 shows diagrammatically, in section, one of the coupling means of the flaps shown in FIG. 5.
Figure 4:
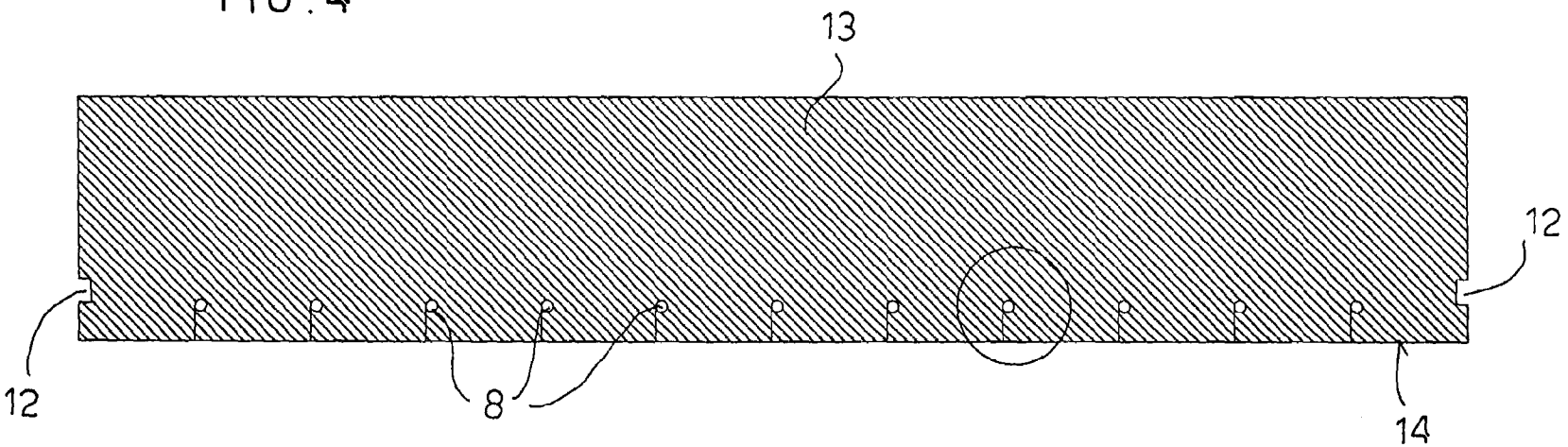
FIG. 4 shows diagrammatically a front view of a flap belonging to the flap wheel of FIG. 2.
Figure 5:
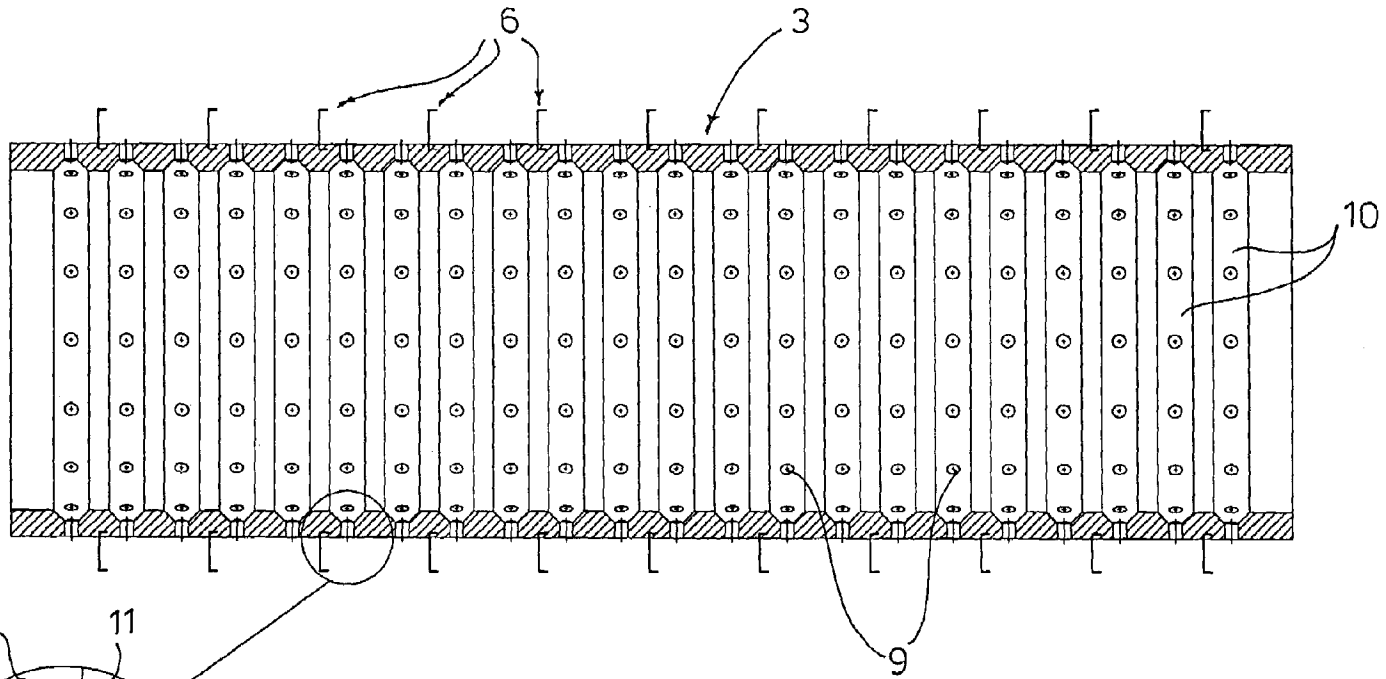
FIG. 5 shows diagrammatically, in section, the hub of the flap wheel of FIG. 2 bearing a first embodiment of the coupling means of the flaps.

A front view of one of the radial flaps can be seen in FIG. 4 and the coupling means 6 can be seen better in FIGS. 5 and 6.

The flaps 2 are advantageously further connected by gluing to the hollow hub 3 by pouring inside the hub 3 an adhesive resin (or other functionally equivalent material) which flows out of a plurality of rows of through holes 9 made in the wall of the hub 3.

Figure 5A:
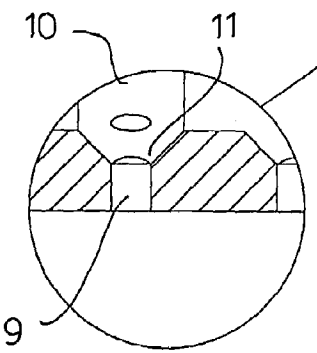

Preferably, a plurality of annular grooves 10 (identical, parallel and equidistant from one another) is formed in the inside wall of the hub 3, each row of through holes 9 is formed on the bottom of one of the grooves 10 and the holes 9 have a slightly flared mouth 11, as can be seen in the enlarged detail of FIG. 5*a*, to facilitate the outflow of the adhesive resin through said holes.

For simplicity of the graphic representation, in FIGS. 2, 4 and 5 only some of the coupling means, of the seats, of the through holes and of the annular grooves are denoted by the relative reference numerals 6, 8, 9 and 10.

Without departing from the scope of the invention, the annular grooves 10 and/or the flared mouths 11 of the through holes 9 can be omitted; again without departing from the scope of the invention, the gluing of the flaps 2 to the hub 3 can be omitted and, consequently, the through holes 9 and the annular grooves 10 can be omitted.

FIG. 3 shows diagrammatically, in section, a terminal flange 4 belonging to a flap wheel 1, which consists of an annular body having, in its peripheral area, a protrusion 5 designed to engage in a niche 12 (FIG. 4) formed in the side edge of each flap 2 near the edge 14 thereof adjacent the hub 3 and a seat 15 designed to receive the portion of the side edge of each flap 2 situated between the niche 12 and the edge 14 of the flap 2.

FIG. 4 shows diagrammatically a front view of a flap 2 belonging to the flap wheel 1 of FIG. 2, which consists of a (preferably) rectangular body 13 of abrasive cloth in the side edges of which there are the niches 12 formed near the edge 14 of the flap 2 which is adjacent the hub 3.

In the edge 14 of the flap 2, which is adjacent the hub 3, there is a plurality of seats 8 (identical, parallel and equidistant from one another) in which the coupling means 6 engage.

Figure 4A:
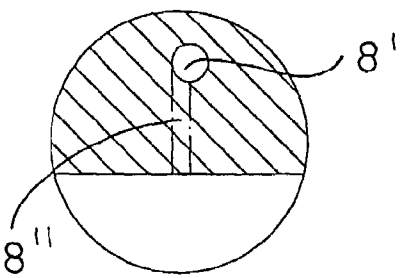

As can be seen in the enlarged detail of FIG. 4*a*, each seat 8 comprises a hole 8' connected to the edge 14 of the flap 2 by a notch 8".

FIG. 5 shows diagrammatically, in section, the hub of the flap wheel 1 of FIG. 2 bearing a first embodiment of the coupling means of the flaps 2.

The coupling means 6 consist of a plurality of C-shaped circular crowns (one of which is shown diagrammatically, in section, in FIG. 6) having an inside diameter no greater than the outside diameter of the hub 3.

The coupling means 6 are preferably made of steel and are partially sunken in the hub 3, as can be seen in FIG. 5.

According to a further possible embodiment of the invention, not illustrated in the appended figures, the hub 3 consists of a plurality of identical annular bodies, adjacent each other and assembled by a motorized sleeve (not shown in the appended figures and per se known) on which the flap wheel 1 is mounted; the coupling means 6 are blocked between two adjacent annular bodies.

The use of a plurality of annular bodies assembled with each other allows the length of the hub 3 to be varied in a modular manner to adapt it to the requirements of the specific application.

Figure 7:
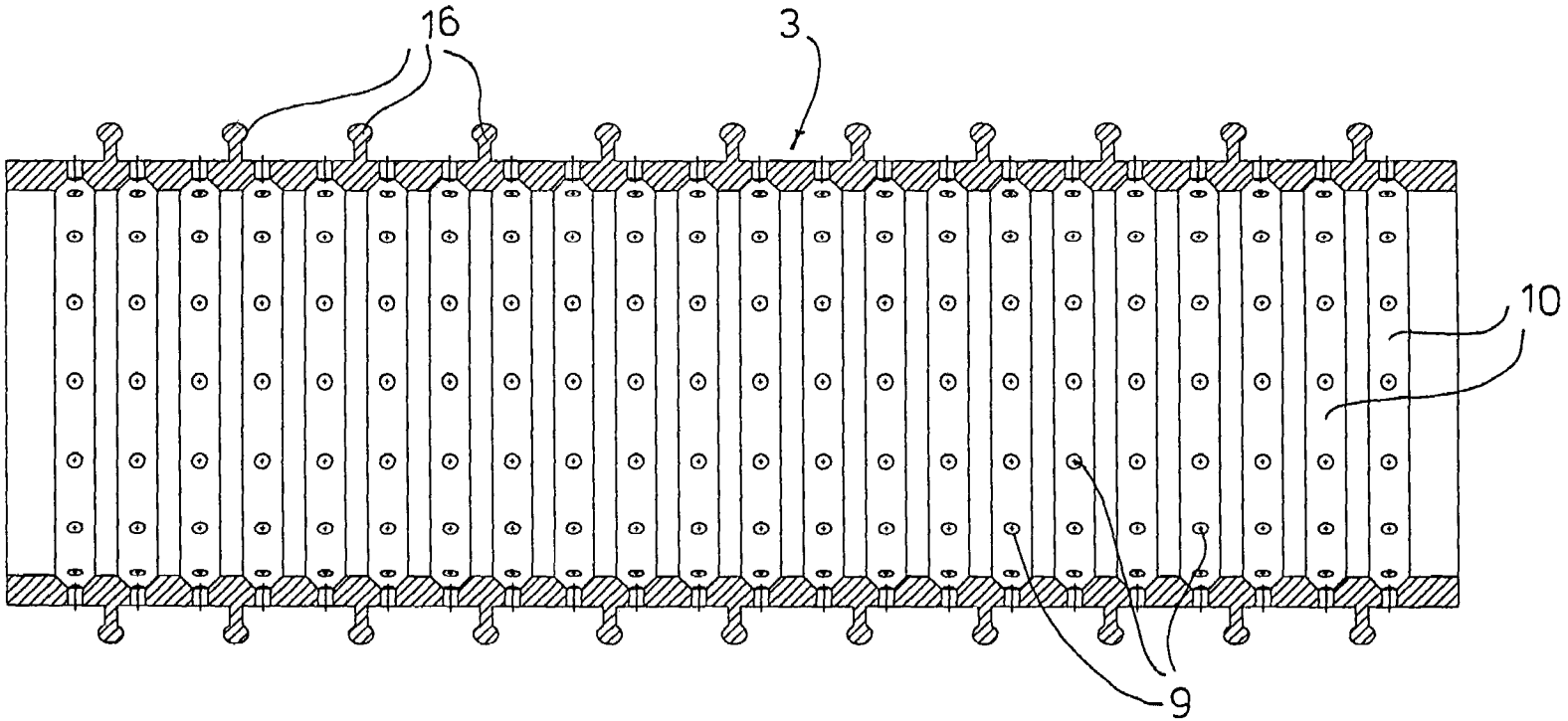
FIG. 7 shows diagrammatically, in section, the hub of the flap wheel of FIG. 2 bearing a second embodiment of the coupling means of the flaps.

FIG. 7 shows diagrammatically, in section, the hub 3 of the flap wheel 1 of FIG. 2 bearing a second embodiment of the coupling means of the flaps 2, which differ from the coupling means 6 shown in FIGS. 2, 5 and 6 in that they consist of a plurality of annular elements 16 protruding from the hub 3 and made (for example by pressing) together with the hub.

If the hub 3 consists of a plurality of identical annular bodies, adjacent each other and assembled by a motorized sleeve on which the flap wheel 1 is mounted, each annular body carries at least one coupling means 16.

The coupling means 16 also are advantageously equidistant from one another.

For simplicity of graphic representation, in FIG. 7 only some of the holes, of the grooves and of the coupling means are identified by means of the relative reference numerals 9, 10 and 16, respectively.

The present invention further refers to a method of producing the above described flap wheel 2, which comprises the following steps:

preparing the hub 3 bearing the coupling means (6, 16), the radial flaps 2 and the side flanges 4;

inserting the coupling means (6, 16) integral with the hub 3 into the seats 8 formed in each radial flap 2 near the edge 14 thereof adjacent the hub 3;

applying to the flap wheel 1 the side flanges 4.

The method advantageously comprises the further steps of:

placing the flap wheel 1 in a mould and heating it;

rotating the heated flap wheel 1 slowly, preferably after having placed it on motorized rollers; and pouring into annular grooves 10 formed in the inside wall of the hub 3 an adhesive resin (or other functionally equivalent material) which flows out of a plurality of rows of through holes 9 formed in the wall of the hub 3 coinciding with the grooves 10.

The temperature to which the flap wheel 1 is heated to keep the adhesive sufficiently fluid depends upon the type of adhesive used; the flap wheel 1 is advantageously heated to about 85° C. and in any case between about 80° C. and about 90° C.

Without departing from the scope of the invention, the flap wheel 1 can also be used in systems for satin finishing of sheet metal.

Again without departing from the scope of the invention, a person skilled in the art can make to the flap wheel of the present invention and to the method of producing it all the modifications and the improvements suggested by the normal experience and/or by the natural evolution of the art.

The invention claimed is:

1. A method of producing a flap wheel (1), in particular a flap wheel for satin finishing systems for pipes or for sheet metal, comprising a plurality of radial flaps (2) fixed to a hub (3) and placed between two side flanges (4), wherein the radial flaps (2) are fixed to the hub (3) of the flap wheel (1) by means of coupling means (6, 16) integral with the hub (3) of the flap wheel (1) and inserted in seats (8) formed in each flap (2) near the edge (14) thereof adjacent to the hub (3), wherein the coupling means (6) consist of a plurality of C-shaped circular crowns having an inside diameter less than the outside diameter of the hub (3) and partially sunken in the hub (3), comprising at least the following steps:

preparing the hub (3) carrying the coupling means (6, 16), the radial flaps (2) and the side flanges (4);

inserting the coupling means (6, 16) integral with the hub (3) into seats (8) formed in each radial flap (2) in proximity to the edge (14) thereof adjacent the hub (3);

applying the side flanges (4) to the flap wheel (1), placing the flap wheel (1) in a mould and heating it;

rotating the heated flap wheel (1); and pouring into the hub (3) an adhesive that flows out of a plurality of rows of through holes (9) formed in the wall of the hub (3).

2. A method according to claim 1, characterized in that the adhesive is poured into annular grooves (10) present inside the hub (3), the rows of through holes (9) being formed in the wall of the hub (3) coinciding with the grooves (10).

3. A method according to claim 1, characterized in that the flap wheel (1) is heated to a temperature between about 80° C. and about 90° C.

4. The method of producing the flap wheel (1) according to claim 1, characterized in that the hub (3) consists of a plurality of identical annular bodies, adjacent one another and assembled by means of a motorized sleeve on which the flap wheel (1) is mounted.

5. The method of producing the flap wheel (1) according to claim 4, characterized in that the coupling means (6) are blocked between the two adjacent annular bodies.

6. The method of producing the flap wheel (1) according to claim 1, characterized in that each terminal flange (4) consists of an annular body having, in its peripheral area, a protrusion (5) designed to engage in a niche (12) formed in the side edge of each flap (2) near the edge (14) thereof adjacent the hub (3) and a seat (15) designed to receive the portion of the side edge of each flap (2) situated between the niche (12) and the edge (14) of the flap (2) adjacent the hub (3).

7. The method of producing the flap wheel (1) according to claim 1, characterized in that each flap (2) consists of a body (13) of abrasive cloth in the side edges of which there are niches (12) formed near the edge (14) of the flap (2) which is adjacent the hub (3) and able to receive one of the side flanges (4) and in that in the edge (14) of the flap (2) which is adjacent the hub (3) there is a plurality of seats (8) in which the coupling means (6) engage.

8. The method of producing the flap wheel (1) according to claim 7, characterized in that each seat (8) comprises a hole (8') connected to the edge (14) of the flap (3) by a notch (8").

9. A flap wheel (1), in particular a flap wheel for satin finishing systems for pipes or for sheet metal, comprising a plurality of radial flaps (2) fixed to a hub (3) and placed between two side flanges (4), wherein the radial flaps (2) are fixed to the hub (3) of the flap wheel (1) by means of coupling means (6, 16) integral with the hub (3) of the flap wheel (1) and inserted in seats (8) formed in each flap (2) near the edge (14) thereof adjacent to the hub (3), there being a plurality of rows of through holes (19) made in the wall of the hub (3), wherein the holes (19) have axial length extending in radial direction through the hub (3) and are aligned in rows parallel to the axis of the hub (3).

10. A flap wheel (1) according to claim 9, characterized in that the through holes (9) have a slightly flared mouth (11).

11. A flap wheel (1) according to claim 9, characterized in that the hub (3) comprises a plurality of annular grooves (10) formed in its inside wall and in that each row of through holes (9) is formed on the bottom of one of the annular grooves (10).

* * * * *